US007070050B2

(12) United States Patent
Fäller et al.

(10) Patent No.: US 7,070,050 B2
(45) Date of Patent: Jul. 4, 2006

(54) TOOL HOLDER FOR COMPOUND NEEDLES, AND SHIPPING UNIT

(75) Inventors: Armin Fäller, Albastadt-Laufen (DE); Andreas Dietz, Baligen (DE); Eckhard Fehrenbacher, Bondorf (DE)

(73) Assignee: Groz-Beckert KG, Albstadt (DE)

( * ) Notice: Subject to any disclaimer, the term of this patent is extended or adjusted under 35 U.S.C. 154(b) by 185 days.

(21) Appl. No.: 10/667,461

(22) Filed: Sep. 23, 2003

(65) Prior Publication Data

US 2004/0055916 A1 Mar. 25, 2004

(30) Foreign Application Priority Data

Sep. 23, 2002 (DE) ..... 102 44 315

(51) Int. Cl.
*B65D 85/24* (2006.01)

(52) U.S. Cl. ..... 206/380; 206/485

(58) Field of Classification Search ..... 206/339, 206/372, 343–347, 380, 381, 443, 485; 211/60.1
See application file for complete search history.

(56) References Cited

U.S. PATENT DOCUMENTS

| | | | | |
|---|---|---|---|---|
| 2,944,662 A | | 7/1960 | Colton | |
| 3,004,660 A | | 10/1961 | Hofmann | |
| 3,452,859 A | | 7/1969 | Hofmann | |
| 4,186,073 A | | 1/1980 | Paganoni | |
| 5,036,975 A | * | 8/1991 | Chow | 206/372 |
| 5,090,607 A | * | 2/1992 | Ohuchi et al. | 206/345 |
| 5,307,924 A | * | 5/1994 | Manosalva et al. | 206/347 |
| 5,497,882 A | * | 3/1996 | Kenyon | 206/485 |
| 5,544,747 A | | 8/1996 | Horn | |
| 5,979,662 A | * | 11/1999 | Green | 206/485 |

FOREIGN PATENT DOCUMENTS

| | | |
|---|---|---|
| DE | 258019 | 3/1912 |
| DE | 260953 | 6/1913 |
| DE | 1103233 B | 3/1961 |
| DE | 3633665 A1 | 4/1988 |

* cited by examiner

*Primary Examiner*—Luan K. Bui
(74) *Attorney, Agent, or Firm*—Venable LLP; Stuart I. Smith; Ryan M. Flandro

(57) ABSTRACT

For keeping knitting tools (2) in readiness and mounting them on knitting machines or other loop-forming machines, a tool holder (4) is provided, which is formed by or contains a transport rail (5). The transport rail (5) has two clamping legs (9, 11), which are parallel to one another and are provided with regularly distributed slots (16, 17). The slots firmly clamp inserted knitting tools by frictional engagement. With the knitting tools (2), the transport rail (5) forms a manipulable unit, in which when it is freely handled, the knitting tools (2) do not fall out of the transport rail (5). The pitch of the transport rail preferably matches the pitch of a needle bed of a machine to be equipped. The equipping of the machine is done by placing the transport rail on the needle bed or attaching it to it and pressing the knitting tools away, in a direction approximately perpendicular to the back portion (6) of the transport rail (5), out of their frictionally engaged mounting into their needle channel. Multi-part knitting tools are thus securely held together in every stage.

15 Claims, 4 Drawing Sheets

TOOL HOLDER FOR COMPOUND NEEDLES, AND SHIPPING UNIT

Figure 1:
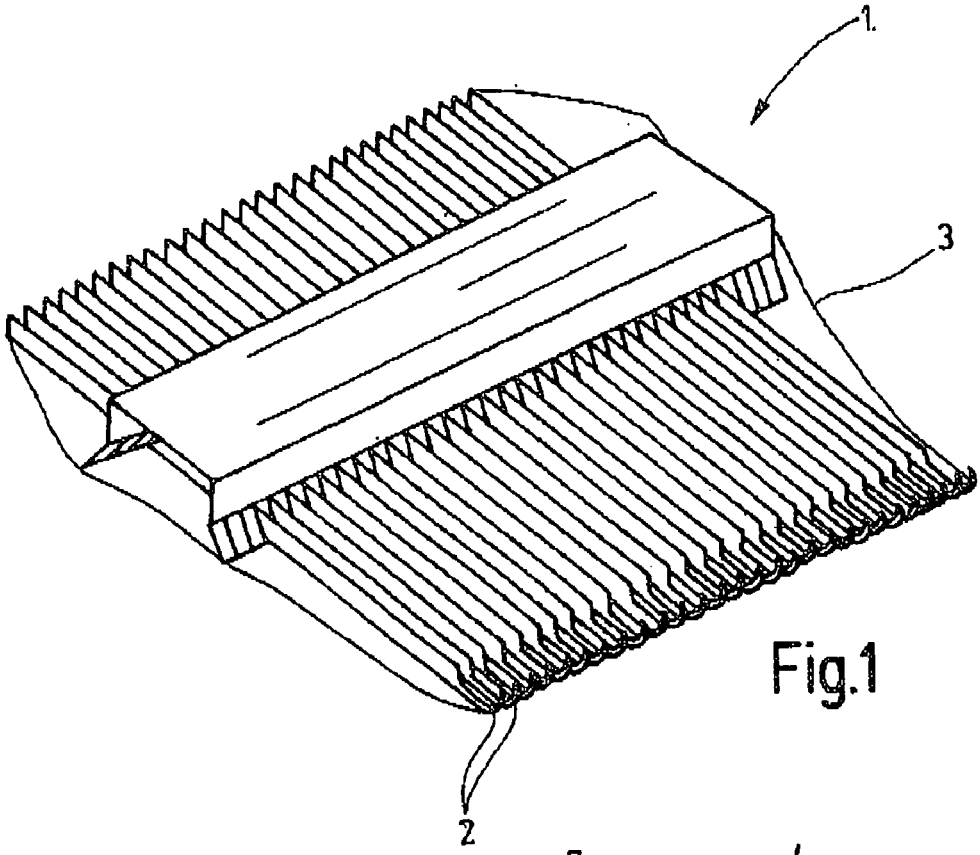

The invention relates to a tool holder for elongated knitting tools and to a shipping unit that contains a plurality of knitting tools packed ready for shipping.

For knitting machines, such as flat knitting machines, circular knitting machines, and the like, knitting tools, such as compound needles, latch needles, selective parts and coupling pieces are needed in great numbers and are produced and delivered separately. The delivery is done both to machine manufacturers and to knitting factories, which in performing maintenance on knitting machines sometimes also change their needles. Inserting needles into the needle bed of a knitting machine requires manual skill and patience and is time-consuming. Especially good fine-motor skills and dexterity are needed, especially if the knitting tool is constructed in multiple parts. This is particularly true if the parts of which the knitting tool is made are not solidly joined together but instead engage one another only by frictional or positive engagement and are not secured against one another until they are seated in the needle channel. This is true for instance in knitting needles that are connected at the end to a coupling part. Moreover, the knitting needle may be composed of a basic body and a slide that are not solidly joined together but are merely held together by frictional engagement.

In the prior art procedure, the needles or other knitting tools are inserted into separate needle beds (transport beds), whose pitch spacing matches the pitch spacing of the knitting machine to be supplied. Equipping these needle beds, used for transport purposes, with the knitting tools is done by the manufacturer of the knitting tools. Each needle bed forms a flat body of rectangular outline, with parallel slots that correspond to the needle channels in the needle beds of a knitting machine. Depending on the application, the knitting tools are received either completely or in part, for instance up to half their length, by the slots. A dovetail slot extends through the needle bed, transversely through all the slots and at a certain spacing or distance above the slot bottoms. A slide inserted here serves to secure the needles in place that are located in the needle bed.

Such needle beds used for transport purposes are relatively heavy and also expensive. Moreover, transferring the needles from the transport needle bed into the machine needle bed still requires a certain manual skill.

With this as the point of departure, it is the object of the invention to create a tool holder for elongated knitting tools, such as compound needles, that is improved with regard to the problems discussed above. This object is attained with a tool holder of claim 1.

The tool holder of the invention comprises a transport rail, or has at least one transport rail, which has slots arranged transversely to its longitudinal direction. Unlike the known needle bed, used for transport purposes, the needle holder of the invention preferably has a width that is markedly less than the length of the knitting tools. As a result, the knitting tools protrude by at least one end out of the tool holder or transport rail and are retained in or on the transport rail. The knitting tools can therefore be transferred especially easily into a machine needle bed. The tool holder need merely be placed against the machine bed in such a way that the individual knitting tools protrude with at least one portion into the needle channel intended for them. From that position, they can then be pressed all the way into the needle channel, leaving the transport rail behind.

The knitting tools are retained in the slots of the transport rail by frictional engagement. No other kinds of securing means are therefore needed to hold the knitting tools individually in the transport rail. This facilitates manipulating the transport rail and the knitting tools, especially upon transfer of the knitting tools to the needle bed of a knitting machine. Such a transport rail can be designed as especially light; it has a low transport weight. It also allows unproblematic manipulation. Equipping a flat knitting machine or a circular knitting machine with appropriate needles proves to be especially simple; no particular manual skill is required.

In a preferred embodiment, the transport rail has two clamping legs, in order to hold together two parts of the knitting tool that belong together. The parts to be held together can for instance be the slide of a knitting needle and a coupling piece, each of which is provided with a butt. The two clamping legs can brace the two butts against one another transversely to the transport rail and thus longitudinally of the knitting needle, so that the slide of the knitting needle is pressed or tensed against a stop that limits its axial stroke. This is advantageous particularly whenever the slide engages an end stop by positive engagement, so that it is secured on the needle in the lateral direction as well, once it is in its (rear) end stop. The multi-part knitting needle thus proves to be a stable unit, as long as it is held in the transport rail.

The knitting needle can also be made in multiple parts in other ways as needed, aside from a slide that may be present. For instance, it may be provided with a coupling piece or selective part that carries the driving butt and optionally also selective butts. A link, with which the selective part or the coupling piece is connected to the knitting needle, can be retained outside the transport rail. This is true at least if it includes securing means that prevent the coupling piece from slipping laterally away from the knitting needle.

The transport rail preferably has two parallel clamping legs, spaced apart from one another, which extend away from the edges of a striplike back portion. In that case, the transport rail has a shallow groovelike design, and the clamping legs are capable of some resilience or yielding in the transverse direction of the transport rail. The transverse direction of the transport rail matches the longitudinal direction of the knitting tools. The spacing of the clamping legs from one another preferably matches the butt spacing of the knitting tools that are braced in the transport rail, when their butts movable counter to one another are in the closest possible position to one another. In the case of a compound needle, for instance, the slide is then in the maximally retracted position. The clamping legs can be braced against one another and as a result can brace the parts of the knitting tool and thus reinforce the knitting tools, which otherwise protrude freely out of the transport rail.

Slots are preferably embodied in the clamping legs, extending away from the back portion of the transport rail. In their width, the slots are dimensioned such that the knitting tools are retained in the slots by frictional engagement. The fixation of the knitting tools in the slots is accomplished independently of the clamping action of the clamping legs. The slots extend transversely to the knitting tool. Each knitting tool, comprising a plurality of individual parts, is thus received by two slots, which are embodied and act as clamping slots. The knitting tool is thereby securely held and yet is still readily accessible.

The slots preferably do not extend as far as the back portion but end before it, in order to offer a contact face to the knitting tools. In a preferred embodiment, the slots extend over only a large proportion of an outward-angled portion of the clamping leg. Preferably, the slots end before the apex of this angle, in order to form an insertion chamfer for equipping the transport rail with knitting tools.

The transport rail is preferably embodied in one piece. For instance, it can be formed by a plastic profile of nonuniform or preferably uniform wall thickness. If it is flexible not only in terms of the resilience of the clamping legs toward and away from one another but also with regard to lateral bending, then the transport rail can be used not only for equipping needle beds of flat knitting machines but also for equipping needle beds of circular knitting machines.

The tool holder of the invention can be completed with a flexible or rigid casing to make a shipping unit, which is equipped and packed by the manufacturer of the knitting tools, and in which the transport rail, which is part of the shipping unit, forms an auxiliary tool, either for the knitting machine manufacturer or the knitter, or both, for introducing the knitting tools into their needle channels. The transport rail thus has a dual function.

Figure 2:
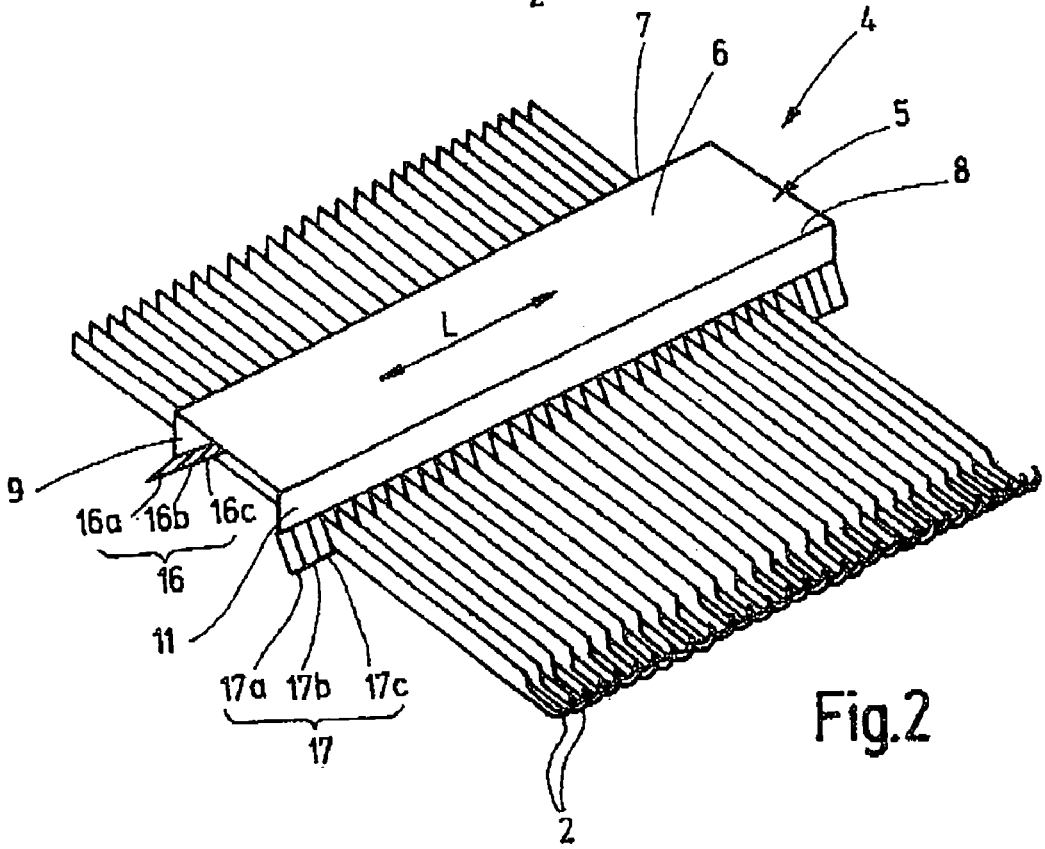
Figure 3:
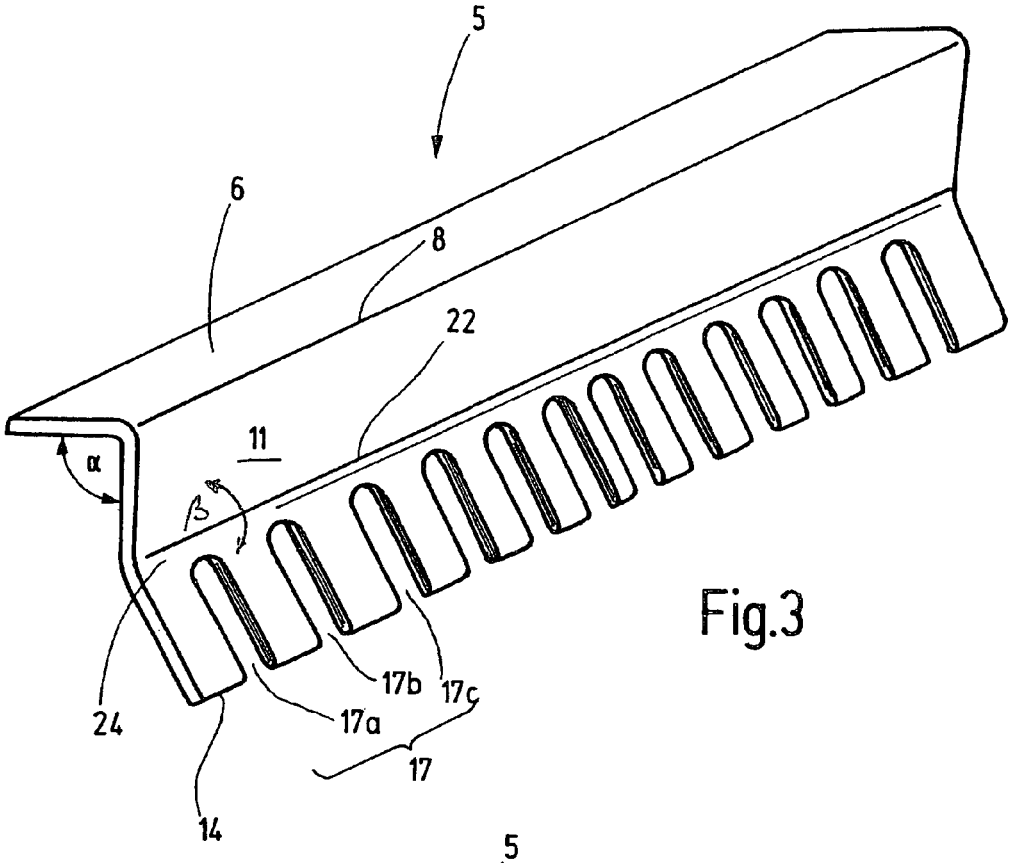
Figure 4:
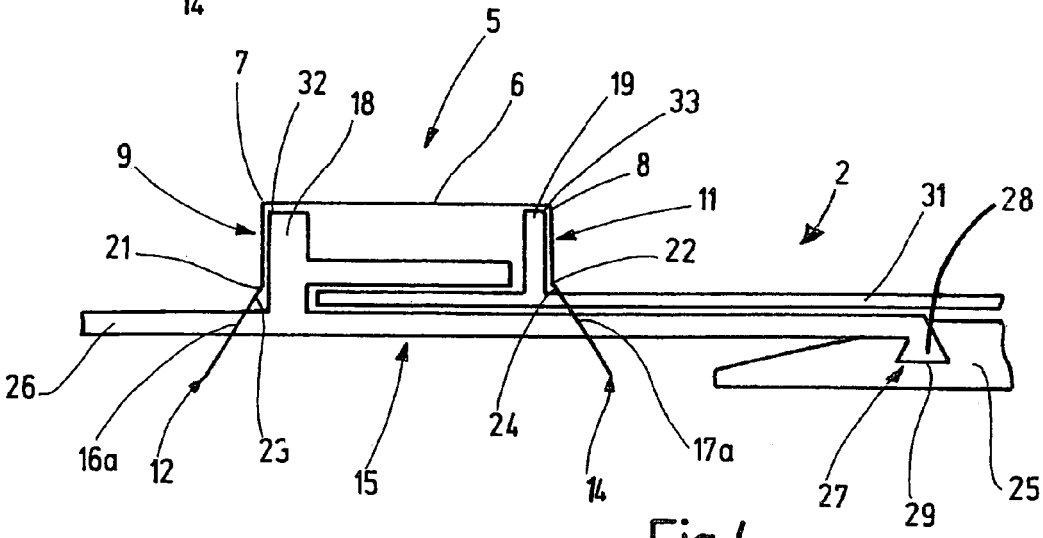
Figure 5:
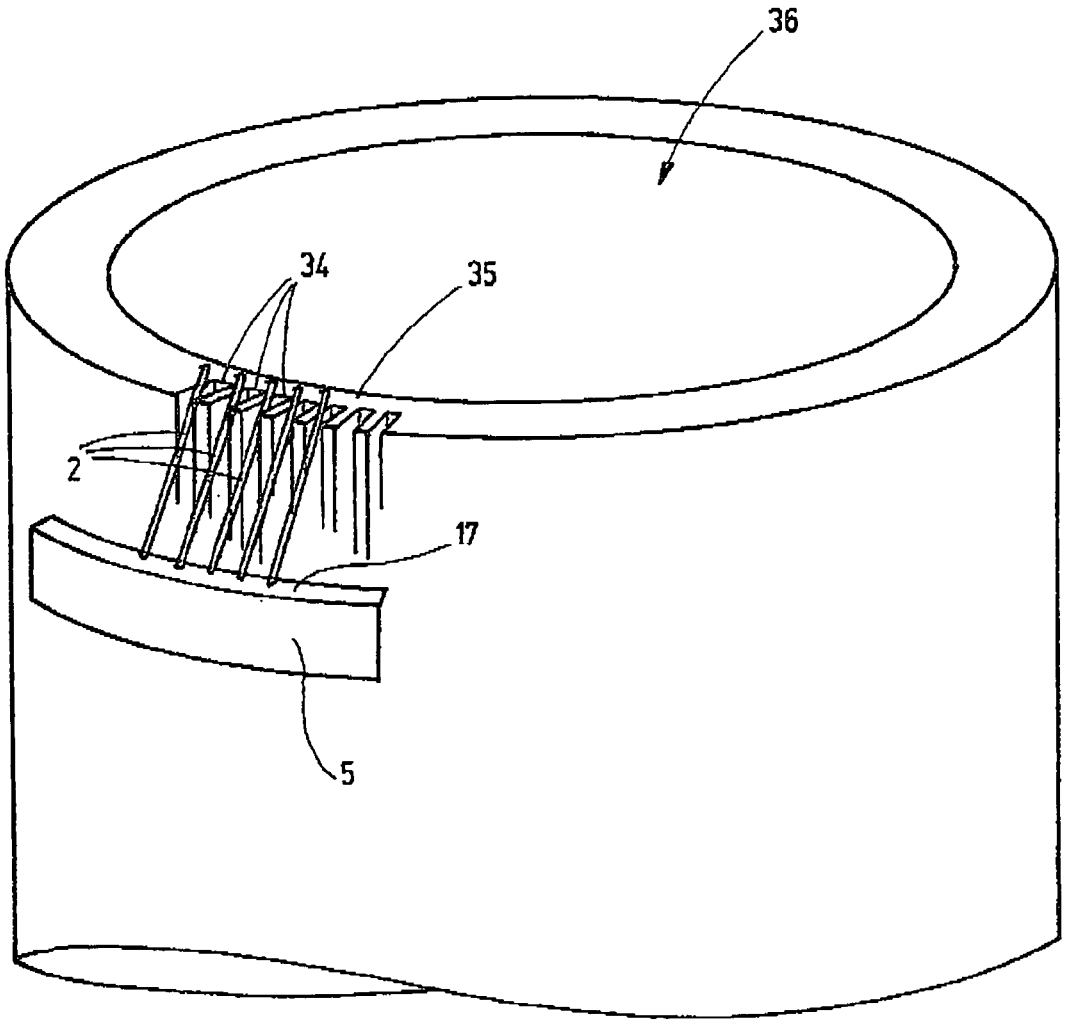
Figure 6:
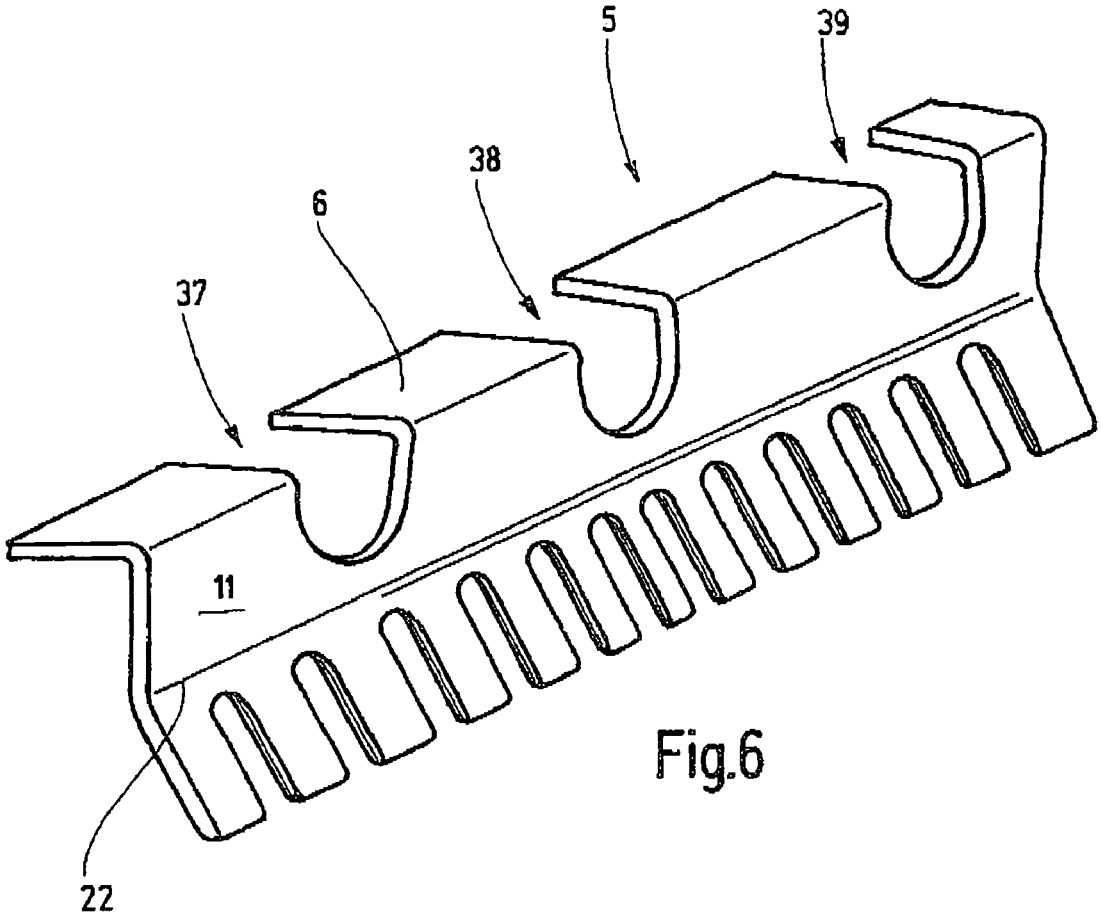

Further details of the invention are the subject of the drawing, the description, or dependent claims. In the drawing, one exemplary embodiment of the invention is shown. Shown are:

FIG. 1, a shipping unit with a tool holder and knitting tools, in perspective;

FIG. 2, the transport rail and the knitting tools of FIG. 1, in perspective;

FIG. 3, the transport rail of FIG. 2 in a detail on a different scale, in perspective;

FIG. 4, the transport rail and the knitting tools of FIG. 2 in a side view;

FIG. 5, a needle cylinder of a circular knitting machine being equipped with knitting tools, in a schematic front view;

FIG. 6, a modified embodiment of a transport rail, in perspective; and

Figure 7:
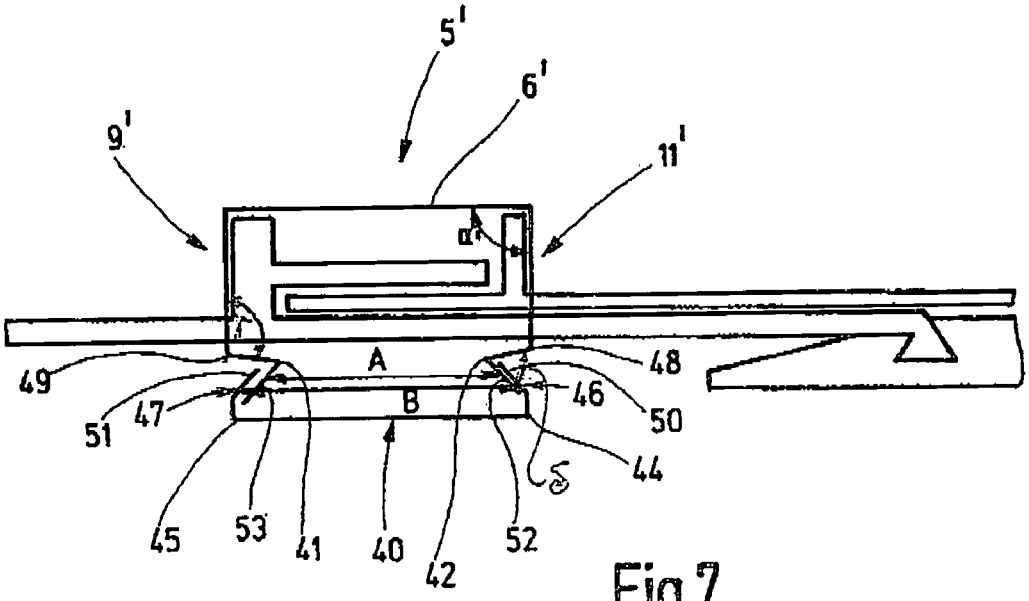

FIG. 7, a modified embodiment of a transport rail with a closure part, in perspective.

In FIG. 1, a shipping unit 1 is shown, with which multi-part knitting tools 2 that are detachably joined together can be shipped. The shipping unit 1 is provided with a casing 3, which can be embodied as rigid or flexible. Wax paper, plastic film, plastic shrink wrap, a folding box, a plastic cassette, or the like can be used as the casing 3. The knitting tools 2 are disposed in the interior of this casing 3 and, as shown separately in FIG. 2, are retained by a tool holder 4.

The tool holder 4, in the present exemplary embodiment, is formed by a transport rail 5, which holds the individual knitting tools. The transport rail 5 is for instance a plastic profile, which is embodied in one piece and, shown in FIG. 3, preferably with a uniform wall thickness. It has a striplike back portion 6, extending in the longitudinal direction L, with two long sharp or rounded edges 7, 8 that are parallel to one another. The edges 7, 8 are marked by bending lines, at which the back portion 6 changes over into the clamping legs 9, 11 adjoining the edges 7, 8. The back portion 6 is embodied as level or flat. The clamping legs 9, 11 are likewise embodied as flat (level, nonwavy), but as seen particularly from FIGS. 3 and 4, they may be bent outward at an angle.

In the region of the edges 7, 8, the clamping legs 9, 11 each form an angle $\alpha$ (see FIG. 3) with the back portion 6. This angle $\alpha$ is a right angle or an acute, nearly right angle. The material comprising the transport rail 5, such as plastic, is selected such that the clamping leg 9, 11 can yield somewhat toward or away from the respective other clamping leg. The acute angle $\alpha$ (which is for instance 80°) can as a result be widened into a right angle by forces that do not cause any damage whatever to the knitting tool 2 to be inserted.

On their ends, the clamping legs 9, 11 each have a closure edge 12, 14, which is approximately parallel to the respective adjacent edge 7 and 8. The closure edges 12, 14 are disposed at a spacing from the back portion 6 that is greater than the height of the part 15 of the knitting tool 2 to be received (see FIG. 4).

For reception of the knitting tool 2 by the clamping legs 9, 11, these clamping legs are each provided with slots 16, 17, which beginning at the respective closure edge 12, 14 extend toward the back portion 6 and thus approximately transversely to the knitting tool 2. The length of the slots 16, 17 is preferably dimensioned such that corresponding parts of the knitting tool 2 that protrude to both sides of the clamping legs 9, 11 past the transport rail 5, come into contact with the slot bottom before butts 18, 19 provided on the knitting tool 2 meet the back portion 6. The width of the back portion 6, as shown in FIG. 4, matches the outer spacing of the butts 18, 19. As a result, once the knitting tools 2 have been inserted into the transport rail 5, the clamping legs 9, 11 are held by tension approximately perpendicular to the back portion 6. In that state, they press elastically against the butts 18, 19. The slots 16, 17 (16*a*, 16*b*, . . . 17*a*, 17*b*) are each disposed at regular spacings from one another. The pitch thus defined matches the pitch of a needle bed to be equipped. Their flanks are flat.

At least one of the clamping legs 9, 11, and preferably both, are bent outward at an angle along a bending line 21, 22. At the bending line 21, 22, the result is an obtuse angle $\beta$, for instance of 110° or 120°. The bending line 21, 22 is disposed parallel to the closure edges 12, 14 and to the edges 7, 8 and is provided at a place that is not reached by the slots 16, 17. The slot bottoms, that is, the terminal boundaries of the slots 16, 17, thus maintain a spacing, of 1 mm or a few millimeters for instance, from the bending lines 21, 22. This creates insertion-facilitating regions 23, 24 between the ends of the slots and the bending lines 21, 22. The length of the insertion-facilitating regions is preferably dimensioned such that the butts 18, 19 of knitting tools 2 to be introduced into the slots 16, 17, as they are being introduced, abut against the insertion-facilitating regions 23, 24 and spread the clamping legs 9, 11, which so far are still completely relaxed, apart somewhat.

The knitting tools 2 to be held by the transport rail 5 can for instance be compound needles. A detail of one such needle is shown schematically in FIG. 4. It has a needle body 25, to which a coupling piece 26 is attached. The coupling piece carries the butt 18 and otherwise extends as an elongated, rodlike part through two slots 16*a*, 17*a*, aligned with one another, of the clamping legs 9, 11. The coupling piece 26 is joined to the needle body 25 via a positive-engagement coupling 27. This coupling is formed by a protrusion 28, provided on the end of the coupling piece 26 and engaging a groovelike recess 29 in the needle body 25. Preferably, positive-engagement or other kinds of securing means are provided here, which prevent the protrusion 28, in the position of the knitting tool 2 shown in FIG. 4, from sliding out of the recess 29.

Another part of the compound needle serving as a knitting tool 2 is a slide 31, whose elongated, rodlike extension extends through the slot 17*a* on into the interior of the transport rail 5. The butt 19 is embodied on this rodlike extension. The butt serves to drive the slide. In the position shown in FIG. 4, the slide is at its rear end stop, relative to the needle body, or in other words is maximally retracted. The butts 18, 19 cannot be moved any farther toward one another; they have reached their greatest possible proximity in FIG. 4. The receiving chamber accordingly holds two parts (the coupling piece 26 and the slide 31) of the knitting tool 2 by the butts 18, 19 provided on them. Both parts are braced against one another in the receiving chamber. The knitting tool 2 is retained in the prestressed state.

The shipping unit, or transport rail 5 equipped with tools 2, described thus far is used as follows:

At the needle manufacturer, the transport rail 5 is first equipped with knitting tools 2. These are inserted individually or in groups into the slots 16, 17. To that end, the butts 18, 19 are first transferred to their position shown in FIG. 4, in which they have their greatest proximity to each other. Next, each knitting tool 2 is pushed, with the butts 18, 19 leading, into the interior of the transport rail 5. The outer ends 32, 33 of the butts 18, 19, once they have moved past their respective slot, reach the insertion-facilitating regions 23, 24 and spread the clamping legs 9, 11 apart somewhat. The knitting tool 2 is then pushed farther into the transport rail 5, until the coupling piece 26 or the slide 31, as applicable, meets the respective slot bottom. The face ends of the butts 18, 19 do not reach the back portion 6, or rest loosely against it. The clamping legs 9, 11 rest with elastic prestressing on the outsides, pointing away from one another, of the butts 18, 19 and thus brace the butts against one another. The knitting tool 2 is retained in its respective slot 16, 17 by frictional engagement.

This is achieved by providing that the width of the slots 16, 17 does not exceed the thickness of at least the coupling piece 26. In addition, the spacings of the slots 16 from one another and the spacings of the slots 17 from one another are uniform and are dimensioned to match the pitch of needle channels 34 of a needle bed 35. The needle bed 35 can be part of a flat knitting machine or part of a needle cylinder 36 of a circular knitting machine.

The knitting tools 2 protruding out from the transport rail 5 can be placed in the needle channels 34 assigned to them in that the transport rail 5, in the position shown in FIG. 5, is moved to approach the needle bed 35. The open ends of the slots 16, 17 then point toward the needle bed 35. The back portion 6 is located on the side away from the needle bed 35.

Once the knitting tools 2 have found their way, with at least a portion of their length, into the respective needle channel 34, they can be pressed out of the transport rail 5 into the needle bed 35. They slide into the needle channel 34 in a relaxed state, but without falling apart. They are securely retained at all times—either by the transport rail 5, or by the side walls of the needle channels of the needle bed 35.

The transport rail 5 of FIG. 3 has a certain flexibility, so that as FIG. 5 shows, it can also be adapted to machine cylinders 36 and used to equip them. Preferably, however, it is intended for equipping needle beds of flat knitting machines. If needle beds with a curvature, such as needle cylinders, are to be equipped, then the transport rail 5 can be modified, as shown in FIG. 6. This transport rail 5 is provided with recesses 37, 38, 39, and optionally other recesses not shown, which pierce the back portion 6. The recesses 37, 38, 39 penetrate the back portion 6 at regular intervals in the transverse direction and preferably extend into the clamping legs 9, 11, but without reaching the bending lines 21, 22. The recesses 37, 38, 39 can be embodied as more or less broad slots. They lead to a flexibility of the transport rail 5, which is desired in some cases, so that the transport rail can be bent flexibly about transverse axes.

A modified embodiment of the tool holder 4 shown in FIG. 7 has a transport rail 5' and closure part or lid 40. The clamping legs 9', 11' of the transport rail 5' are bent at angles along spaced-apart bending lines 41, 42 and 48, 49. In other words, they are bent twice, at striplike or linear regions spaced apart from one another. Inward at the bending line 48, 49, resulting in an obtuse angle $\gamma$, for instance of 110° or 120°, and outward in their end portions 52, 53 at the bending line 41, 42, resulting in an acute angle $\delta$, for instance of 60° or 70°. The end portions 52, 53 are disposed at a spacing A, which is determined approximately at half the height of the end portions, from one another and diverge from one another.

The lid 40 is for instance a plastic profile, which is embodied in one piece and preferably has the same, uniform wall thickness. It has a striplike back portion 43, extending in its longitudinal direction, with two long, parallel, sharp or rounded edges. The edges 44, 45 are marked by bending lines, at which the back portion 43 changes over into clamping legs 46, 47 that adjoin the edges 44, 45. The back portion 40 is embodied as level or flat. The clamping legs 46, 47 are also embodied as flat (level, nonwavy), and they have an end portion 50, 51 bent inward at an angle and in this region are adapted in their end portions 52, 53 to the form of the clamping legs 9', 11'. The end portions 50, 51 are disposed at a spacing B from one another that is determined at approximately half the height of the end portions. The inner spacing B of the clamping legs 46, 47 is slightly less than the outer spacing A of the clamping legs 9', 11'. As a result, the position of the clamping legs 9', 11', or in other words the angle $\alpha'$, can be varied, and thus the clamping action on the knitting tools 2 can be varied. Another advantage of this embodiment is that the angle $\alpha'$ can be obtuse, which makes installing the knitting tools easier, and that the insertion-facilitating region 23, 24 is not necessary.

The knitting tools 2 are received in the same way as described above in the slots 16', 17' intended for them. The slot bottoms, that is, the terminal boundary of the slots 16', 17', are disposed closer to the back portion 43 than the bending line 48, 49. Using the reference numerals already mentioned, reference may be made to the description of FIGS. 1–6. It applies here accordingly.

Embodiments are also conceivable in which the spacing of the bottoms of the slots 16', 17' from the back portion 6' is greater than the spacing of the bending lines 48, 49 from the back portion 6'. This means that the slots 16', 17' end in the angled region of the clamping legs.

In another embodiment of the tool holder 4, not shown here further, the length of the slots 16, 16' differs from the length of the slots 17, 17'. As a result, the bottom of the slot 16, 16' has a different spacing from the back portion 6, 6' than does the bottom of the slot 17, 17'. As a result, the knitting tools 2 are received in angled form in the tool holder and are thus not parallel to the back portion 6, 6'. An angular disposition of the knitting tools 2 can be advantageous in the process of equipping the needle bed.

For keeping knitting tools 2 in readiness and mounting them on knitting machines or other loop-forming machines, a tool holder 4 is provided, which is formed by or contains a transport rail 5. The transport rail 5 has two clamping legs 9, 11, which are parallel to one another and are provided with regularly distributed slots 16, 17. The slots firmly clamp inserted knitting tools by frictional engagement. With the knitting tools 2, the transport rail 5 forms a manipulable unit, in which when the unit is freely handled, the knitting tools 2 do not fall out of the transport rail 5. The pitch of the transport rail preferably matches the pitch of a needle bed of a machine to be equipped. The equipping of the machine is done by placing the transport rail on the needle bed or attaching it to it and pressing the knitting tools away, in a direction approximately perpendicular to the back portion 6 of the transport rail 5, out of their frictionally engaged mounting into their needle channel. Multi-part knitting tools are thus securely held together in every stage.

List of Reference Numerals:

| | |
|---|---|
| 1 | Shipping unit |
| 2 | knitting tools |
| 3 | Casing |
| 4 | Tool holder |
| 5, 5' | Transport rail |
| 6, 6' | Back portion |
| 7, 8, 44, 45 | Edges |
| 9, 11, 9', 11' | Clamping legs |
| 12, 14 | Closure edge |
| 15 | Part |
| 16, 17 | Slots |
| 18, 19 | Butts |
| 21, 22, 41, 42, 48, 49 | Bending line |
| 23, 24 | Insertion-facilitating regions |
| 25 | Needle body |
| 26 | Coupling piece |
| 27 | Coupling |
| 28 | Protrusion |
| 29 | Recess |
| 31 | Slide |
| 32, 33 | Ends |
| 34 | Needle channels |
| 35 | Needle bed |
| 36 | Needle cylinder |
| 37, 38, 39 | Recesses |
| 40 | Lid |
| 43 | Back portion |
| 46, 47 | Clamping legs (lid) |
| 50, 51, 52, 53 | End portion |
| L | Longitudinal direction |
| A, B | Spacing |

The invention claimed is:

1. A tool holder for holding elongated knitting tools, comprising:

a transport rail extending longitudinally, the transport rail including a back portion;

a plurality of first clamping legs extending at an angle from longitudinally extending edges of the back portion and being adapted to hold together at least two parts of each of the knitting tools; and a plurality of slots disposed along each of the clamping legs, the slots being adapted to transversely receive the knitting tools and being further adapted to retain the knitting tools by frictional engagement; and a closure part having a plurality of second clamping legs adapted to abut the first clamping legs of the transport rail, wherein the first clamping legs of the transport rail include first end portions having an outer spacing from one another, and the second clamping legs of the closure part include second end portions having an inner spacing from one another, the inner spacing of the second clamping legs of the closure part being less than the outer spacing of the first clamping legs of the transport rail.

2. The tool holder of claim 1, wherein the slots are spaced relative to one another so as to define a pitch adapted to match a predetermined pitch defined by a plurality of needle channels in a knitting machine.

3. The tool holder of claim 1, wherein the first clamping legs are disposed parallel to and spaced apart from one another.

4. The tool holder of claim 1, wherein the first clamping legs are resilient.

5. The tool holder of claim 1, wherein at least one of the first clamping legs has a portion that diverges away from the other first clamping leg.

6. The tool holder of claim 5, wherein the diverging portion of the at least one first clamping leg defines an obtuse angle with the other first clamping leg.

7. The tool holder of claim 5, wherein the plurality of slots are entirely disposed on in the diverging portion.

8. The tool holder of claim 1, wherein the transport rail is one piece.

9. The tool holder of claim 1, wherein the transport rail is plastic.

10. The tool holder of claim 9, wherein the plastic transport rail has a uniform wall thickness.

11. The tool holder of claim 1, wherein the transport rail is flexible.

12. The tool holder of claim 1, wherein the closure part is adapted to fit over the transport rail.

13. The tool holder of claim 1, wherein the plurality of slots on one of the plurality of clamping legs have lengths that differ from the lengths of the plurality of slots on the other clamping leg.

14. A shipping unit having a tool holder according to claim 1, wherein the knitting tools are inserted into the plurality of slots.

15. The shipping unit of claim 14, further comprising a casing.

* * * * *